US009878549B1

(12) United States Patent
Fima et al.

(10) Patent No.: US 9,878,549 B1
(45) Date of Patent: Jan. 30, 2018

(54) DEVICES, SYSTEMS AND METHODS FOR INKJET PRINT HEAD MAINTENANCE

(71) Applicant: Nano-Dimensions Technologies, Ltd., Nes Ziona (IL)

(72) Inventors: Sharon Fima, Kibutz Palmahim (IL); Dotan Sela, Mazkeret Batya (IL)

(73) Assignee: Nano-Dimension Technologies, Nes-Ziona (IL)

( * ) Notice: Subject to any disclaimer, the term of this patent is extended or adjusted under 35 U.S.C. 154(b) by 0 days.

(21) Appl. No.: 15/385,878

(22) Filed: Dec. 21, 2016

(51) Int. Cl.
*B41J 2/165* (2006.01)

(52) U.S. Cl.
CPC .. *B41J 2/16552* (2013.01); *B41J 2002/16555* (2013.01)

(58) Field of Classification Search
CPC .. B41J 2/16552; B41J 2/16505; B41J 2/1652; B41J 2/16532; B41J 2002/16555
See application file for complete search history.

(56) References Cited

U.S. PATENT DOCUMENTS

2011/0261109 A1* 10/2011 Lin ..... B41J 2/16552 347/28
2012/0249673 A1* 10/2012 Mita ..... B41J 2/16552 347/33
2015/0146120 A1* 5/2015 Maida ..... B41J 2/16535 349/33

* cited by examiner

*Primary Examiner* — Juanita D Jackson
(74) *Attorney, Agent, or Firm* — Guy Levi; The IP Law Firm of Guy Levi, LLC

(57) ABSTRACT

The disclosure relates to devices, systems and methods for contactless maintenance of inkjet print heads. Specifically, the disclosure relates to devices, systems and methods for removing purged ink from inkjet print head without contacting the aperture plate by drawing vacuum, with liquids or other mechanical means, such as wipes.

54 Claims, 9 Drawing Sheets

DEVICES, SYSTEMS AND METHODS FOR INKJET PRINT HEAD MAINTENANCE

BACKGROUND

The disclosure is directed to devices, systems and methods for contactless maintenance of inkjet print heads. Specifically, the disclosure is directed to devices, systems and methods for removing purged ink from inkjet print head without contacting the aperture plate with liquid or other mechanical means.

Inkjet printing heads require periodic cleaning of printing nozzles to remove buildup (solid sediments) on the nozzles, remove air bubbles, and otherwise maintain printing quality. Cleaning the printing head is a significant part of the inkjet printing process, for example in some industrial settings the printing head is cleaned as often as every two minutes. The frequency of cleaning depends on the specific application for which the printing head is being used. Typically, cleaning can also be done by removing the print head to one side of the printer for easy access and cleaning the head either manually or using a wiper. These methods are time consuming and inefficient.

An orifice plate, can be located on the printing side (lower surface) of the printing head, providing access for the nozzles to print, while potentially also providing protection for the printing head. Jetted ink from each nozzle can exits the orifice for printing. During periodic cleaning and/or after purging, the orifice surface can be cleaned to remove buildup, purged liquid, and enable proper jetting of the printing liquid from the nozzles (via the orifices). In order to preserve the smoothness and high interfacial tension between the printing side and the jetted ink (non-wetting characteristic) and the orifice surface, care must be taken in performing wiping.

Typically, removing content without contact to the orifice plate can be done using vacuum where a vacuum 'head' is moved across the orifice plate. The vacuum head can be maneuvered sufficiently close to allow the vacuum induced suction, to remove the jetted liquid from the orifice plate. Because the vacuum head does not contact the orifice plate, efficiency of the orifice plate cleaning is low. Similarly, service stations have an elastomeric wiper that wipes the print head surface to remove ink residue, as well as other debris that has collected on the face of the print head. Other service stations include auxiliary wiping members to clean areas of the pen adjacent to the ink ejecting nozzles.

Moreover, when the ink contains volatile components, the ink at a tip of a nozzle may lose those components, resulting in certain circumstances in the remaining ingredients of the ink forming a semi-solid skin at the nozzle tip. The semi-solid skin, or buildup of solid sediments, can interfere with the jetting of ink from the nozzles, reducing the quality or even disabling jetting of ink from one or more nozzles. As the nozzle tips are aligned with orifices in an orifice plate, sediment buildup can also be on the orifices and/or orifice plate.

There is therefore a need for a system for cleaning an orifice plate, with increased efficiency over conventional techniques, preventing sediment buildup and additionally, not damaging the orifice plate itself.

SUMMARY

Disclosed, in various embodiments, are devices, systems and methods for removing purged ink from inkjet print head without contacting the orifice plate with liquid or other mechanical means.

In an embodiment provided herein is a contactless inkjet print head cleaner comprising: an elongated slab having a proximal end and a distal end disposed on opposite sides of the longitudinal axis of the elongated slab, an anterior side disposed transverse to the longitudinal axis, a posterior side disposed opposite to the anterior side, an apical surface and a basal surface; a platform having a longitudinal axis in parallel with the longitudinal axis of the slab, the platform defining a plurality of parallel channels disposed transverse to the longitudinal axis of the platform, each channel having a posterior end is in communication with a pressurized cleaning gas medium and an anterior end in fluid communication with an anterior suction duct; a proximal spacer extending apically from the platform and a distal spacer extending apically from the rectangular platform.

In another embodiment, provided herein is a method of cleaning an inkjet print head comprising: providing a contactless inkjet print head cleaner comprising: an elongated slab having a proximal end and a distal end disposed on opposite sides of the longitudinal axis of the elongated slab, an anterior side disposed transverse to the longitudinal axis, a posterior side disposed opposite to the anterior side, an apical surface and a basal surface; a platform having a longitudinal axis in parallel with the longitudinal axis of the slab, the platform defining a plurality of parallel channels disposed transverse to the longitudinal axis of the platform, each channel having a posterior end in communication with a pressurized cleaning gas medium and an anterior end in fluid communication with a suction duct; a proximal spacer extending apically from the platform and a distal spacer extending apically from the rectangular platform; coupling the inkjet print head to the apical surface of the slab, abutting the proximal and distal spacers, thereby creating a cleaning gap; contacting the cleaning gap with the pressurized cleaning gas medium; purging ink from the inkjet print head; using the suction duct, removing the purged ink from the anterior end of each of the plurality of parallel channels.

In yet another embodiment, provided herein is a system for recycling inkjet ink comprising: a contactless inkjet print head cleaner comprising: an elongated slab having a proximal end and a distal end disposed on opposite sides of the longitudinal axis of the elongated slab, an anterior side disposed transverse to the longitudinal axis, a posterior side disposed opposite to the anterior side, an apical surface and a basal surface; a platform having a longitudinal axis in parallel with the longitudinal axis of the slab, the platform defining a plurality of parallel channels disposed transverse to the longitudinal axis of the platform, each channel having a posterior end is in communication with a pressurized cleaning gas medium and an anterior end in fluid communication with an anterior suction duct; a proximal spacer extending apically from the platform and a distal spacer extending apically from the rectangular platform; a vacuum pump, in communication with the suction duct; a pressurized vessel, holding the pressurized cleaning gas medium; a degassing tank, in communication with the anterior suction duct, coupled to the vacuum pump; an ink reservoir, in fluid communication with the degassing tank; and a print head, in fluid communication with the ink reservoir.

In an embodiment, provided herein is a contactless inkjet print head cleaner comprising: an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface; a platform with longitudinal axis aligned in parallel to the longitudinal axis of the slab, the platform defining a distally slanted proximal sink portion, a distally slanted distal sink portion, a proximally sloped channel, a distal drainage bore, and a proximal drainage bore wherein the distal drainage bore and proximal drainage bore are in fluid communication with a basin defined in the platform, the basin further having a main drainage conduit, the main drainage conduit being in communication with a vacuum source; and a cylindrical suction nipple operably coupled to the proximal drainage bore, the suction nipple having a suction tube coaxially disposed and in communication with the basin.

In another embodiment, provided herein is a method of purging ink from an inkjet print head having a proximal end, a distal end, and an orifice plate, the method comprising: providing a contactless inkjet print head cleaner comprising: an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface; a platform with longitudinal axis aligned in parallel to the longitudinal axis of the slab, the platform defining a distally slanted proximal sink portion, a distally slanted distal sink portion, a proximally sloped channel, a distal drainage bore, and a proximal drainage bore wherein the distal drainage bore and proximal drainage bore are in fluid communication with a basin defined in the platform, the basin further having a main drainage conduit, the main drainage conduit being in communication with a vacuum source; and a cylindrical suction nipple operably coupled to the proximal drainage bore, the suction nipple having a suction tube coaxially disposed and in communication with the basin; while sliding the orifice plate proximally along the longitudinal axis of the platform, purging ink from the print head when the distal end of the print head is aligned with the distal end of the platform; and using the vacuum source to apply vacuum, slidably coupling the inkjet print head to the cylindrical suction nipple, leaving a cleaning gap; and using the main drainage conduit, removing the purged ink from basin.

These and other features of the cleaners, devices, methods, and systems for removing purged ink from inkjet print head without contacting the aperture plate with liquid or other mechanical means, will become apparent from the following detailed description when read in conjunction with the figures and examples, which are exemplary, not limiting.

BRIEF DESCRIPTION OF THE FIGURES

For a better understanding of the cleaning devices, methods, and systems for removing purged ink from inkjet print head without contacting the aperture plate with liquid or other mechanical means, with regard to the embodiments thereof, reference is made to the accompanying examples and figures, in which.

DETAILED DESCRIPTION

Figure 1:
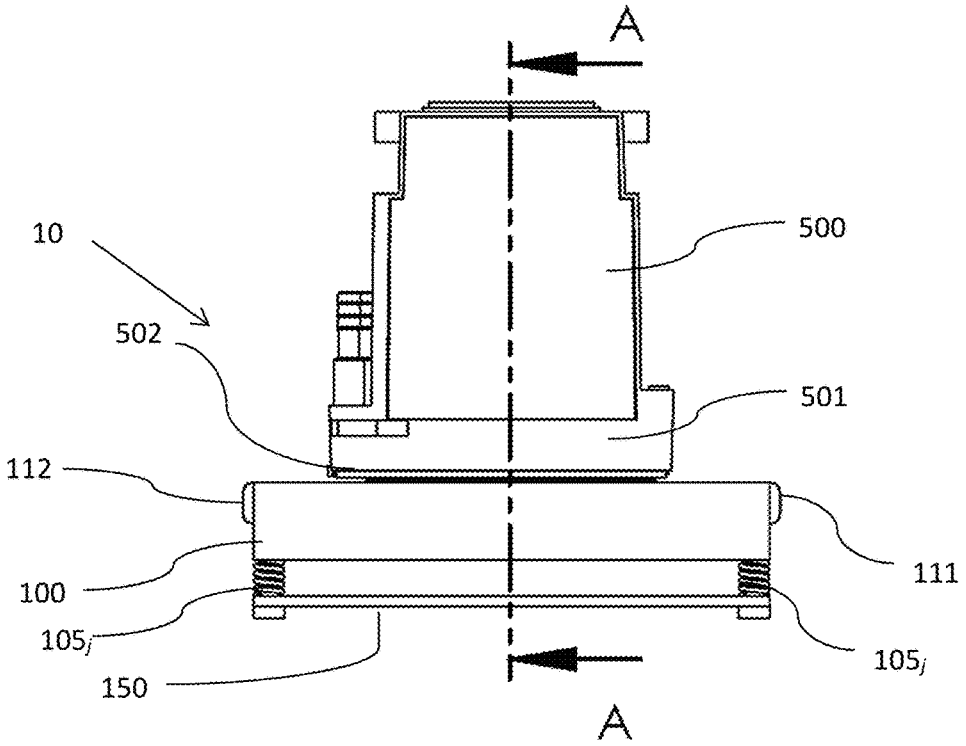
FIG. 1 illustrates a side view elevation of the inkjet printing head(s) coupled to an embodiment of the cleaner.

Provided herein are embodiments of cleaners, devices, systems and methods for removing purged ink from inkjet print head without contacting the aperture plate with liquid or other mechanical means.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning to FIGS. 1-5 illustrating a contactless inkjet print head cleaner 10 comprising: elongated slab 100 having a proximal end and a distal end disposed on opposite sides of the longitudinal axis x of elongated slab 100, an anterior side disposed transverse to longitudinal axis x, a posterior side disposed opposite to the anterior side, an apical surface and a basal surface; platform 125 having a longitudinal axis in parallel with longitudinal axis x of elongated slab 100, platform 125 defining plurality of parallel channels $\mathbf{126}_i$ disposed transverse to longitudinal axis x of platform 125. Each $i^{th}$ channel $\mathbf{126}_i$ can have a posterior end be in communication with a pressurized cleaning gas medium (not shown, see e.g., 701 FIG. 10) and an anterior end in fluid communication with anterior suction duct 106 (see e.g., FIG. 5). The platform can further have proximal spacer 140 that can extend apically (in other words, upwards) from platform 125 and distal spacer 141 extending apically from rectangular platform. Proximal 140 and distal 141 spacers are configured to define the cleaning gap between cleaner 100 and print head 500, orifice plate 502 (see e.g., FIG. 2).

The term "fluid communication" or "liquid communication" refers to any area, a structure, or communication that allows for fluid communication between at least two fluid retaining regions, for example, a tube, duct, conduit or the like connecting two regions. One or more fluid communication can be configured or adapted to provide for example, vacuum driven flow, electrokinetic driven flow, control the rate and timing of fluid flow by varying the dimensions of the fluid communication passageway, rate of circulation or a combination comprising one or more of the foregoing. Alternatively, and in another embodiment, the term "in communication" can also refer to gaseous communication, i.e. that gas may be transferred from one volume to another volume since these volumes are in communication. This term does not exclude the presence of a gas shutter or valve between the volumes that may be used to interrupt the gas communication between the volumes.

Figure 7:
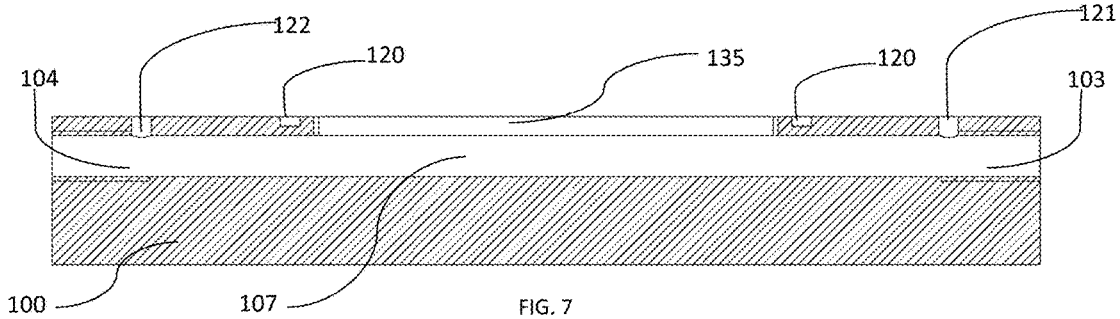
FIG. 7, illustrates a schematic F-F cross section Y-Z view of an embodiment of the cleaner embodiment illustrated in FIG. 4.
Figure 8:
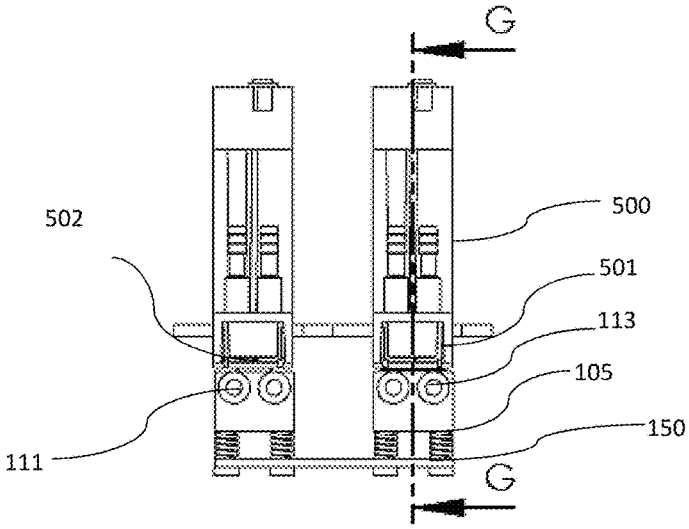
FIG. 8, illustrates a front elevation view of the inkjet printing head(s) coupled to an embodiment of the cleaner.

The posterior end of each of the plurality of channels $\mathbf{126}_i$ defined in the apical (in other words, the top) surface of slab 100 of the cleaner slab described herein, can terminate in longitudinal posterior groove 135 (see e.g., FIGS. 3, 4, 7) adjoining the plurality of transverse channels $\mathbf{126}_i$. In other words, the $i^{th}$ parallel channels $\mathbf{126}_i$ can form comb teeth, adjoined at their posterior (or rear) end, by cross posterior groove. The length of each $i^{th}$ channel of plurality of transverse channels $\mathbf{126}_i$ can be, for example between about 0.2 mm and about 2.0 mm and have a length of about 1.0 mm and about 15 mm. In another embodiment, the length of each $i^{th}$ channel of plurality of transverse channels $\mathbf{126}_i$ can be configured to more than span the width of inkjet print head's 500 (IJ PH) transverse dimension of orifice plate 502. Similarly, posterior groove 135, is configured to more than span the longitudinal length of orifice plate 135. Generally, the plurality of transverse channels $\mathbf{126}_i$ connecting (in other words, terminating, or initiating) posterior groove 135 on their posterior end and longitudinal anterior groove 130 (see e.g., FIGS. 3, 4, 5).

Figure 2:
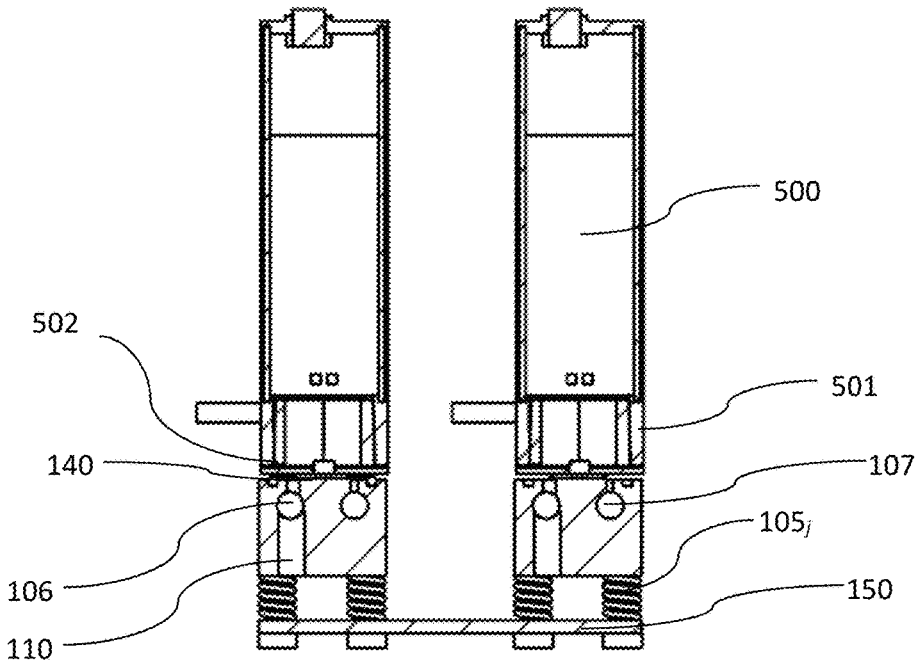
FIG. 2, illustrates a Y-Z cross section A-A of the embodiment illustrated in FIG. 1.
Figure 3:
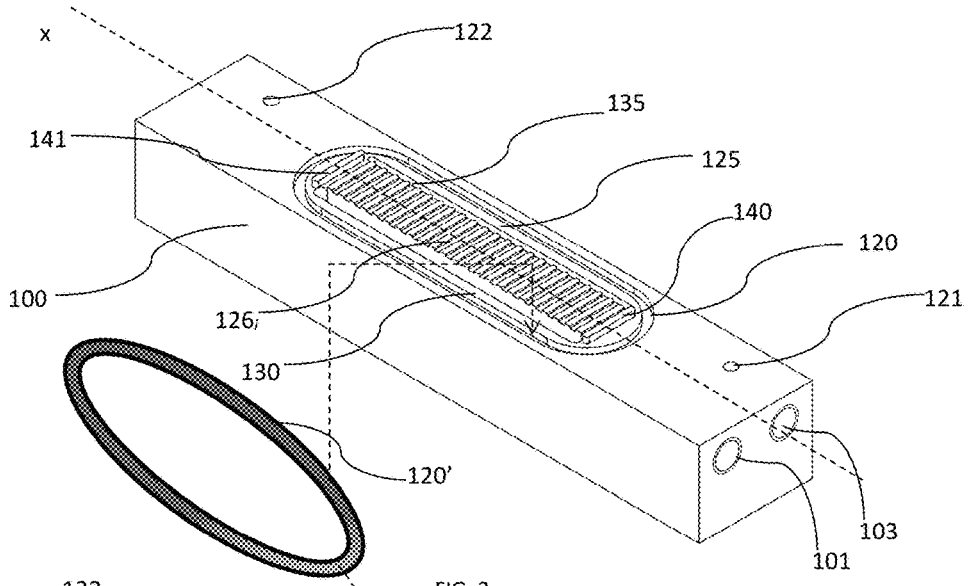
FIG. 3, illustrates an isometric perspective view of an embodiment of the cleaner slab.
Figure 4:
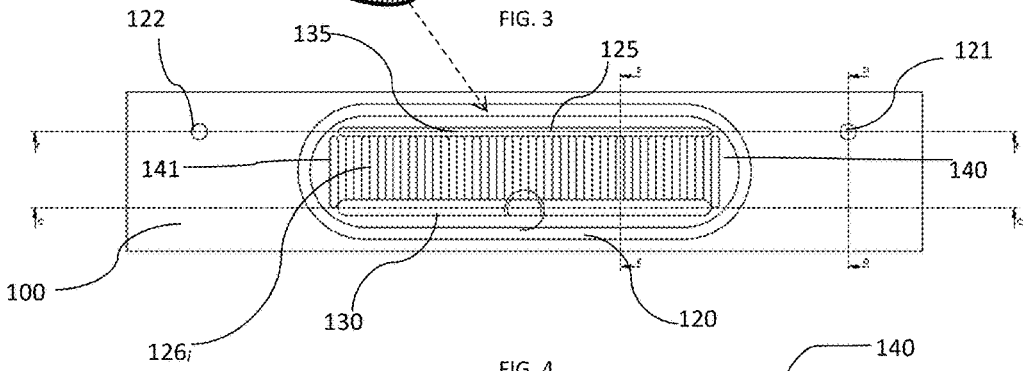
FIG. 4 illustrates a top plan view of the first embodiment of an embodiment of the cleaner illustrated in FIG. 3.
Figure 5:
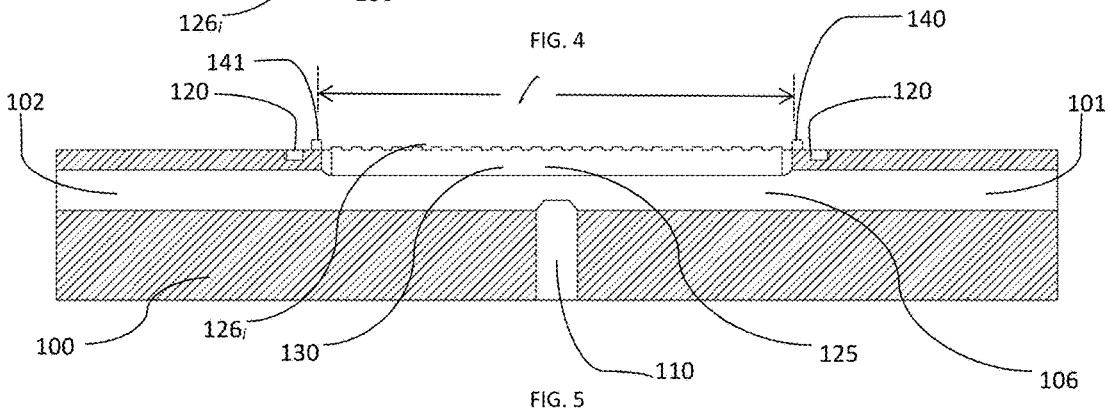
FIG. 5 illustrates a schematic C-C cross section Y-Z view of an embodiment of the cleaner embodiment illustrated in FIG. 4.
Figure 9A:
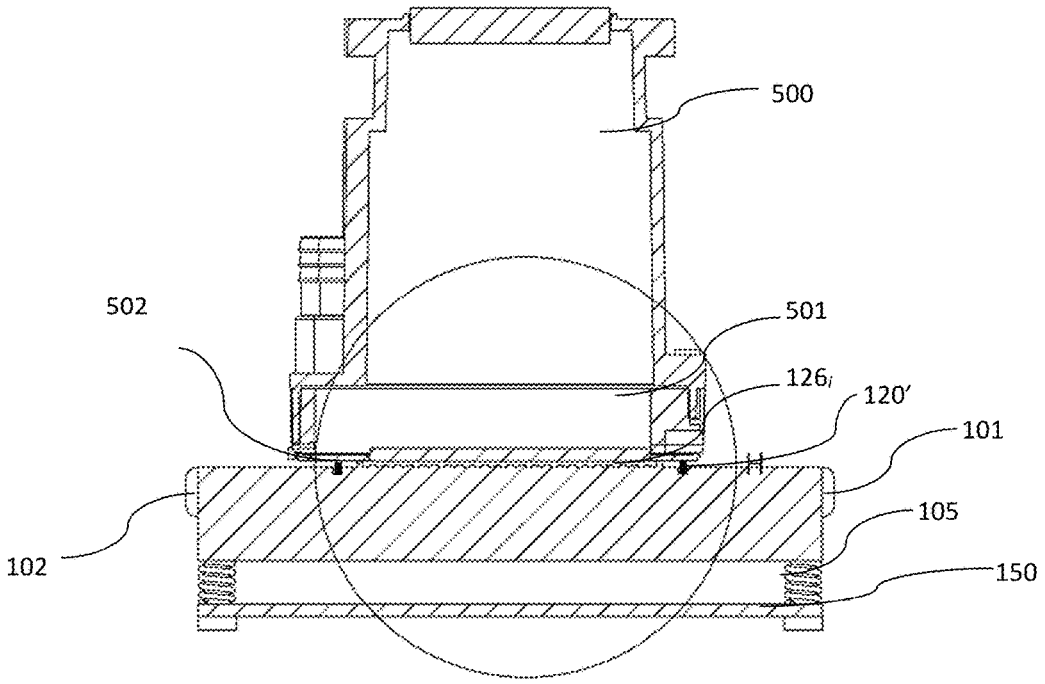
FIG. 9A illustrates a schematic G-G cross section X-Z view of an embodiment of the cleaner illustrated in FIG. 8; with FIG. 9B, illustrating enlarged portion H from FIG. 9A.
Figure 9B:
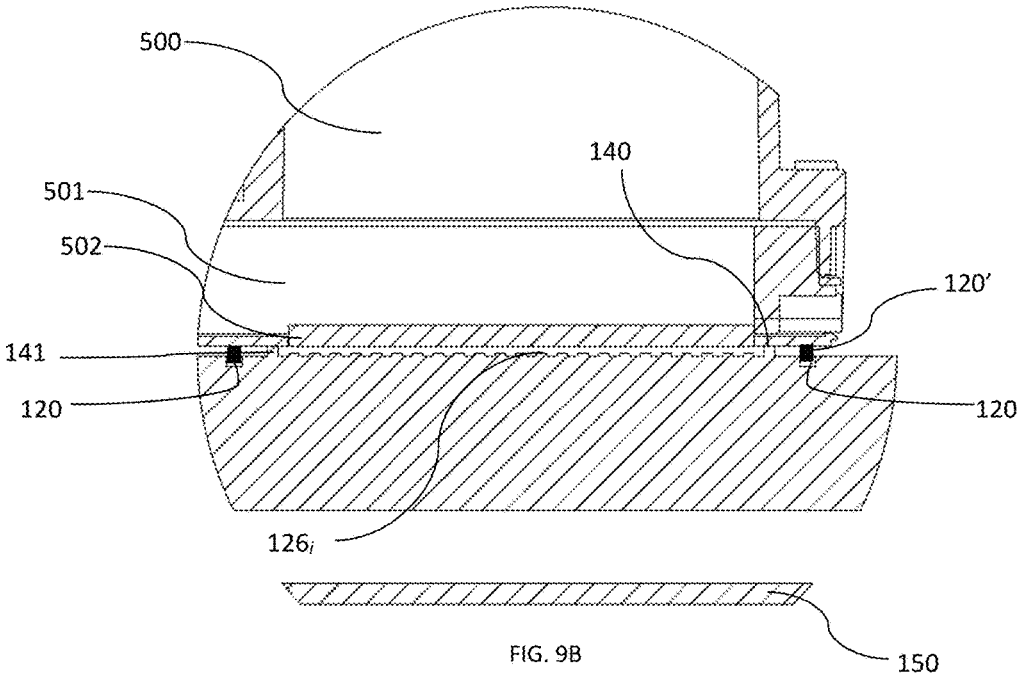

Also shown in FIGS. 1 and 3, are caps 111 and 112, capping proximal end 101 and distal end 102 (see e.g., FIG. 2) of anterior suction duct 106 (see e.g., FIG. 5), as well as vibration dampeners $\mathbf{105}_j$, coupling cleaner slab 100 to base member 150 (see e.g., FIGS. 1, 2). Further, as illustrated in FIGS. 3-5, platform 125, having plurality of transverse channels $\mathbf{126}_i$ defined thereon, as well as proximal 140 and distal 141 spacers, are all surrounded by peripheral O-ring canal 120 configured to receive and engage O-ring sealer 120' (see e.g., FIG. 3), adapted to form a closed sealed environment between the apical surface of slab 100 and print head 500 orifice plate 502 (see e.g., FIG. 9B).

Figures 6A, 6B:
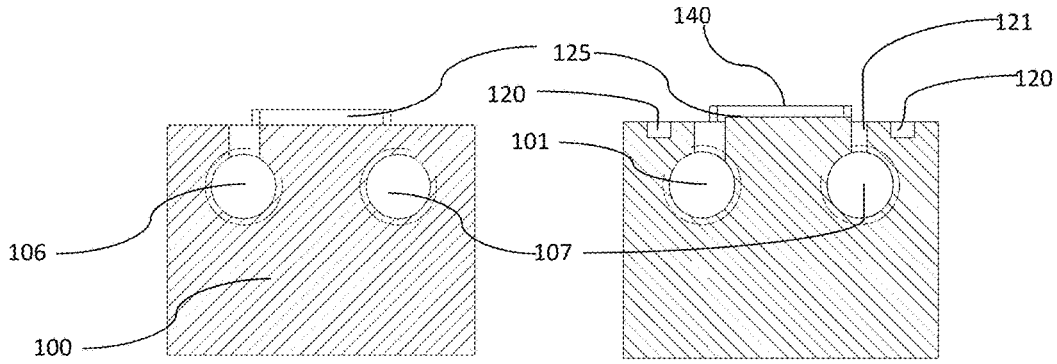
FIG. 6A, illustrates a schematic E-E cross section Y-Z view, with FIG. 6B illustrating a schematic D-D cross section Y-Z view of an embodiment of the cleaner embodiment illustrated in FIG. 4.

In an embodiment, longitudinal posterior groove 135 used in the contactless cleaner for removing purged inkjet print head ink described herein can be in communication with longitudinal posterior duct 107 extending longitudinally from proximal end 103 (see e.g., FIG. 2) to distal end 104 (see e.g., FIG. 2) of cleaner slab 100 (see e.g., FIG. 2). Further, the apical surface of slab 100 further defines proximal posterior bore 121 and distal posterior bore 122, each of the proximal posterior bore 121 and distal posterior bore 122 extending basally from the apical surface to posterior duct 107 (see e.g., FIG. 6B). The proximal and distal bores 121, 122, can be used for example, to connect to a pressurized cleaning gas medium, for example air, and be configured to create cleaning gas flow (see e.g., 701, FIG. 10) through posterior duct 107 to longitudinal posterior groove 135. In certain applications the gas flow can be, for example; argon, nitrogen and the like. Either of bores 121, 122 can be selectably plugged in normal operation and be used for equilibrating pressure and cleaning when needed. In an embodiment, the term "selectably" means that the subsequent operation can be done upon demand by a user without affecting other operations and/or elements.

The flowrate of the cleaning gas medium (e.g., air) can be configured to induce a Venturi effect within the transverse channels $\mathbf{126}_i$ when coupled to inkjet print head 500 abutting proximal 140 and distal 141 spacers forming a gap narrowed by platform 125 and orifice plate 502. The closed environment is formed by the seal created between the apical surface of slab 100 through O-ring sealer 120' disposed in O-ring canal 120 (see e.g., FIG. 9A, 9B) and the basal surface of print head 500 orifice plate 502. The term "Venturi effect" refers in an embodiment to the reduction in fluid pressure that results when a gas or fluid flows through a constricted section of tube, channel (e.g., each $i^{th}$ channel of plurality of transverse channels $\mathbf{126}_i$), or pipe; wherein the constricted area causes a decrease in pressure and results in suction of the purged ink along each $i^{th}$ channel of plurality of transverse channels $\mathbf{126}_i$ from posterior groove 135 toward anterior groove 130 and into anterior suction duct 106. Alternatively and in addition, the term "Venturi effect" refers to increases in fluid speed when a fluid is forced past a narrow or restricted area. The increased speed results in a reduction in pressure. Similarly, as used herein, the term "Venturi channel" can be used in reference to a direct venting means comprising a restricted area (e.g., each $i^{th}$ channel of plurality of transverse channels $\mathbf{126}_i$) in which a Venturi effect is produced. It is noted, that air flow through the gap formed in the closed environment within the area defined inside O-ring canal 120 sealed with O-ring 120' and print head 500 orifice plate 502, abutting proximal and distal spacers 140, 141, can be configured to provide Venturi effect without transverse channels $\mathbf{126}_i$, due to the narrowing of the gap between the apical surface of gap 100 and the base of orifice plate 502 by platform 125.

In an embodiment, maintenance procedures utilizing the contactless cleaners described herein, can typically include purging ink through apertures of the print head, which can also be referred to as "burping", and creating a Ventury effect beneath aperture plate 502 to remove ink and debris from the surface of aperture plate 502. In order to purge ink from print head 500 of e.g., FIG. 9B, a purge pressure may be applied to ink in an on-board reservoir (not shown) using a pressure source (e.g., air pump, or compressed air tank) through an opening, or vent, operably coupled to print head 500. In an embodiment, the term "purge pressure" refers to the pressure of air (or other gas) applied to ink in an on-board reservoir that is configured to urge ink from the reservoir through the inkjet ejectors and be released from the apertures in aperture plate 502. It is noted that purging can be done independent of the type of cleaning device coupled to print head 500, for example, with the cleaning device 20 illustrated in e.g., FIGS. 11A, 13A, and 13B as well.

Turning now to FIGS. 3-5, and as described, the anterior end of each $i^{th}$ channel of plurality of transverse channels $\mathbf{126}_i$ defined and used in the contactless cleaner described herein can terminate in longitudinal anterior groove 130 adjoining the plurality of channels $\mathbf{126}_i$, creating a trough or a sink to collect the ink and other components purged and sought to be removed. As illustrated in FIG. 5, longitudinal posterior groove 130 can be in (fluid) communication with longitudinal anterior suction duct 106 extending longitudinally from the proximal end 101 to distal end 102 of slab member 100. Moreover, the basal surface of slab member 100 can further define median anterior drain 110 (see e.g., FIG. 5), which can extend apically (or upwards) from the basal surface to anterior suction duct 106. As used herein, the term "median" indicates that the location of median anterior drain 110 is between proximal 140 and distal 141 spacers along longitudinal axis x (See e.g., FIG. 3). Median anterior drain 110 defined and used in the contactless cleaner described herein can be operably coupled to vacuum source (see e.g., 600, FIG. 10). The vacuum source can be, for example a vacuum pump, Venturi tube or the like.

In certain embodiments, ejection of ink from aperture plate 502 can employ a piezoelectric element, which repeatedly applies and reduces pressure to eject ink, and can cause minute bubbles to form due to cavitation, or through turbulence once purged, or through air or gas entrainment by the relatively high velocity gas over the plurality of transverse channels. Therefore, in an embodiment, median anterior drain 110 can be in fluid communication with degassing tank (see e.g., tank 200, FIG. 10), which can be disposed between median anterior drain 110 and the vacuum source (e.g., the vacuum pump). The degassing tank, or chamber can be maintained at sub atmospheric pressure, thereby creating a pressure gradient that will pull purged ink from anterior suction duct 106, selectably once it is filled or on a continuous basis.

In an embodiment, the contactless cleaners described herein, are used in the methods described. Accordingly and in another embodiment, provided herein is a method of cleaning inkjet print head 500 (see e.g., FIG. 10) comprising: providing contactless inkjet print head cleaner 10 (See e.g., FIG. 1) comprising: elongated slab 100 having a proximal end and a distal end disposed on opposite sides of longitudinal axis x (see e.g., FIG. 3) of elongated slab 100, an anterior side disposed transverse to longitudinal axis x, a posterior side disposed opposite to the anterior side, an apical surface and a basal surface, with platform 125 having a longitudinal axis in parallel with longitudinal axis x of elongated slab 100. Platform 125 is defining a plurality of parallel channels 126*i* disposed transverse to longitudinal axis x of platform 125, each $i^{th}$ channel $\mathbf{126}_i$ having a posterior end in communication with a pressurized cleaning gas medium and an anterior end in fluid communication with suction duct 106. The platform further having proximal spacer 140 extending apically from platform 125 and distal spacer 141 extending apically from platform 125. The method further comprising coupling inkjet print head 500 to the apical surface of elongated slab 100, abutting the proximal 140 and distal 141 spacers, thereby creating a cleaning gap; contacting the cleaning gap with the pressurized cleaning gas medium; purging ink from inkjet print head 500; using the suction duct, 106, removing the purged ink from the anterior end of each $i^{th}$ transverse channel of plurality of parallel transverse channels $\mathbf{126}_i$.

The steps of contacting the cleaning gap with the pressurized cleaning gas medium, and purging ink from inkjet print head 500 can be done simultaneously or in reverse order. In addition, the step of coupling inkjet print head 500 to the apical surface of elongated slab 100, abutting the proximal 140 and distal 141 spacers, thereby creating a cleaning gap, can be done by, for example, creating a maintenance station to which print head 500 and/or contactless cleaner 10 can be translated.

Likewise, in the step of contacting the cleaning gap with the pressurized cleaning gas medium (see e.g., 701, FIG. 10), proximal posterior bore 121 and/or distal posterior bore 122, can be in communication with the source of pressurized cleaning gas medium, configured to create cleaning gas flow through the posterior duct to the cleaning gap (see e.g., FIG. 9B), provide cleaning gas flow rate sufficient to induce a Venturi effect within the cleaning gap.

The ink and other components (e.g., build up residue, solid sediment and the like) suctioned off using the system described herein can be transported to a recycling system (see e.g., FIG. 10), modified and returned to print head 500 ink reservoir. The recycling sub-system may comprise various components, for example filters, adsorbing elements, manifolds, addition of various solvents and additives and the like. Generally, the term "recycling" refers to a sub-system used to reprocess the purged content of anterior suction duct 106 to a condition where it can be used effectively in the printing operation carried out.

Figure 10:
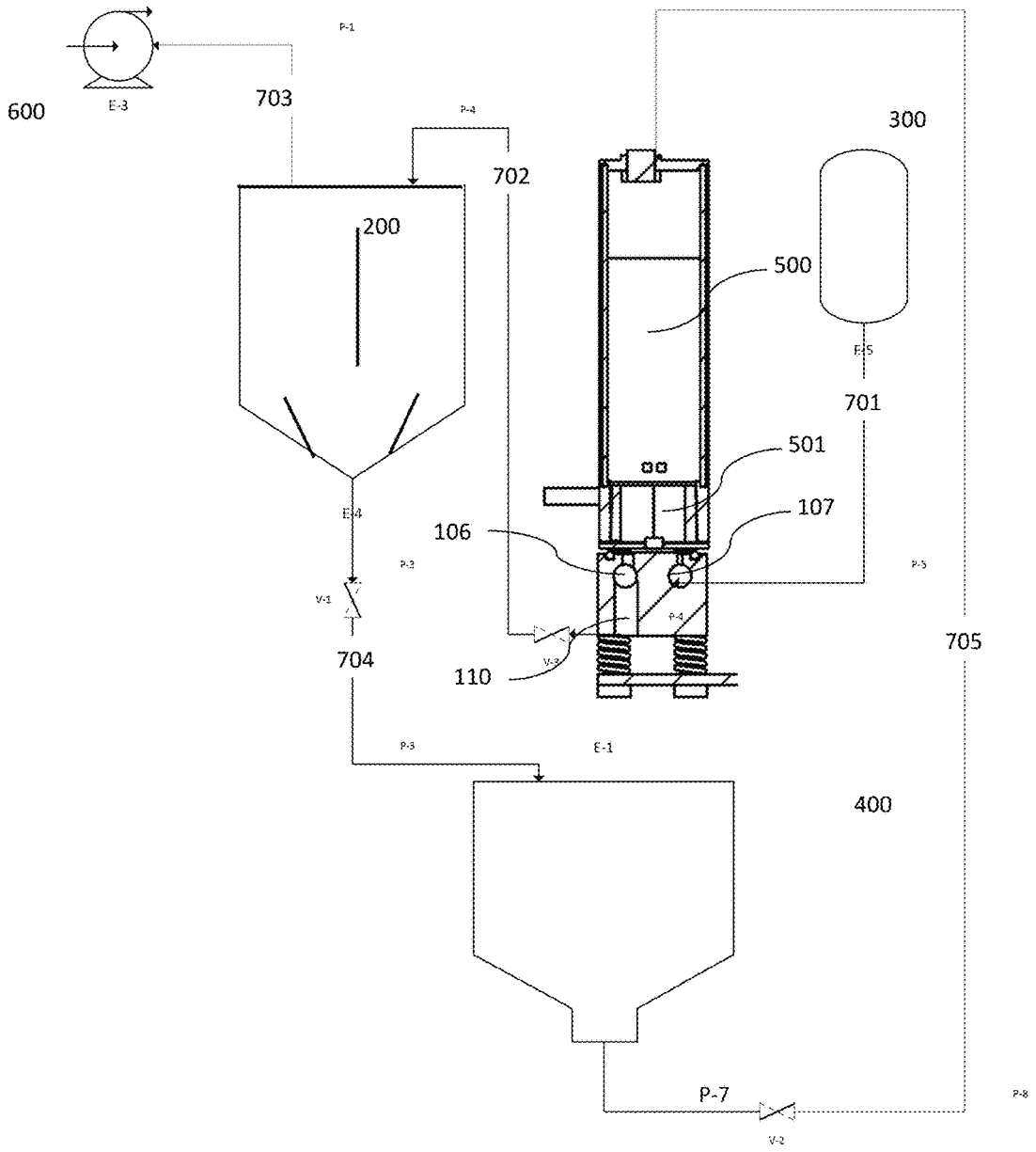
FIG. 10, illustrates the system components' architecture for recycling the ink.

Accordingly and in an embodiment, the step of removing the purged ink from the anterior end of each of the plurality of parallel channels in the methods described herein, can further comprises removing the purged ink to a degassing tank (see e.g., 702, FIG. 10). Upon removing the purged ink and other components, using valves (see e.g., V-3, FIG. 10), shunts and other processing components, flow of purged ink and other components can be stopped and the degassing tank is isolated from the ambient pressure system of contactless cleaner 10, whereby, using the vacuum source, the ink is degassed (see e.g., 703, FIG. 10). Following the degassing of the ink, and optionally further treatment to remove undesired components (e.g., sediments, build up residue, etc.) the vacuum source is disconnected from the degassing tank and the degassed and optionally treated ink is allowed to flow to ink reservoir 400 (see e.g., 704, FIG. 10). Once full, or on-demand, or periodically, the degassed ink from ink reservoir 400 can be transported (e.g., using various pumps or positive pressure), to inkjet print head 500 internal reservoir (see e.g., 705, FIG. 10), thereby recycling the ink.

Accordingly, as illustrated in FIG. 10, provided herein is a system for recycling inkjet ink comprising: contactless inkjet print head cleaner 10 comprising: elongated slab 100 having a proximal end and a distal end disposed on opposite sides of longitudinal axis x of the elongated slab, an anterior side disposed transverse to the longitudinal axis, a posterior side disposed opposite to the anterior side, an apical surface and a basal surface; platform 125 (see e.g., FIG. 3) having longitudinal axis in parallel with longitudinal axis x of elongated slab 100, platform 125 defining plurality of parallel channels $\mathbf{126}_i$ disposed transverse to the longitudinal axis of platform 125, each $i^{th}$ channel having a posterior end is in communication with a pressurized cleaning gas medium and an anterior end in fluid communication with anterior suction duct 106; proximal spacer 140 extending apically from platform 125 and distal spacer 141 extending apically from platform 125; vacuum pump 600, in communication with suction duct 106; pressurized vessel 300, holding the pressurized cleaning gas medium; degassing tank 200, in communication with anterior suction duct 106, coupled to vacuum pump 600; ink reservoir 400, in fluid communication with degassing tank 200; and print head 500, in fluid communication with ink reservoir 500.

Figure 11A:
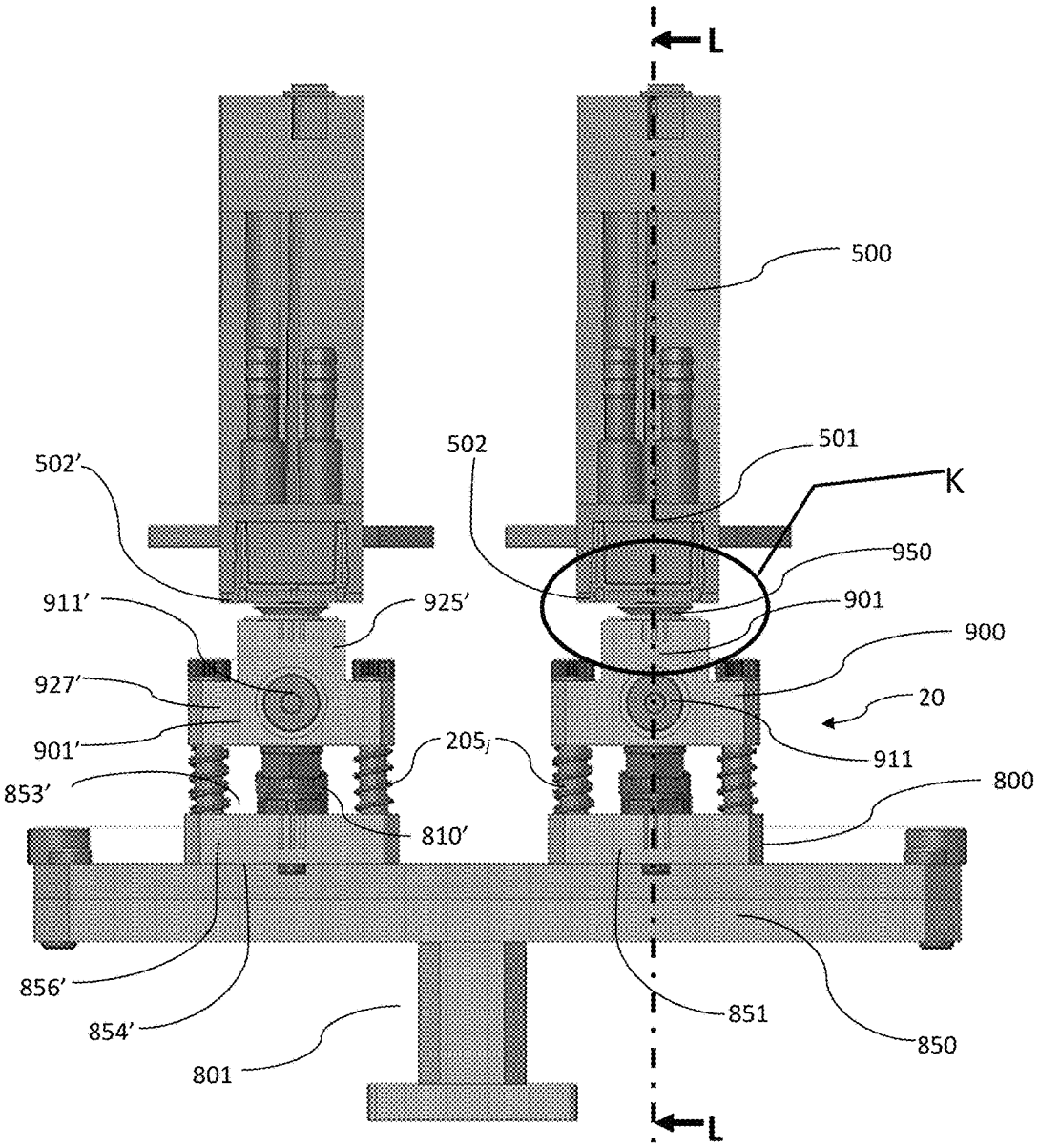
FIG. 11A, a front elevation view of the inkjet printing head(s) coupled to another embodiment of the cleaner, with FIG. 11B illustrating enlarged portion K.
Figure 13A:
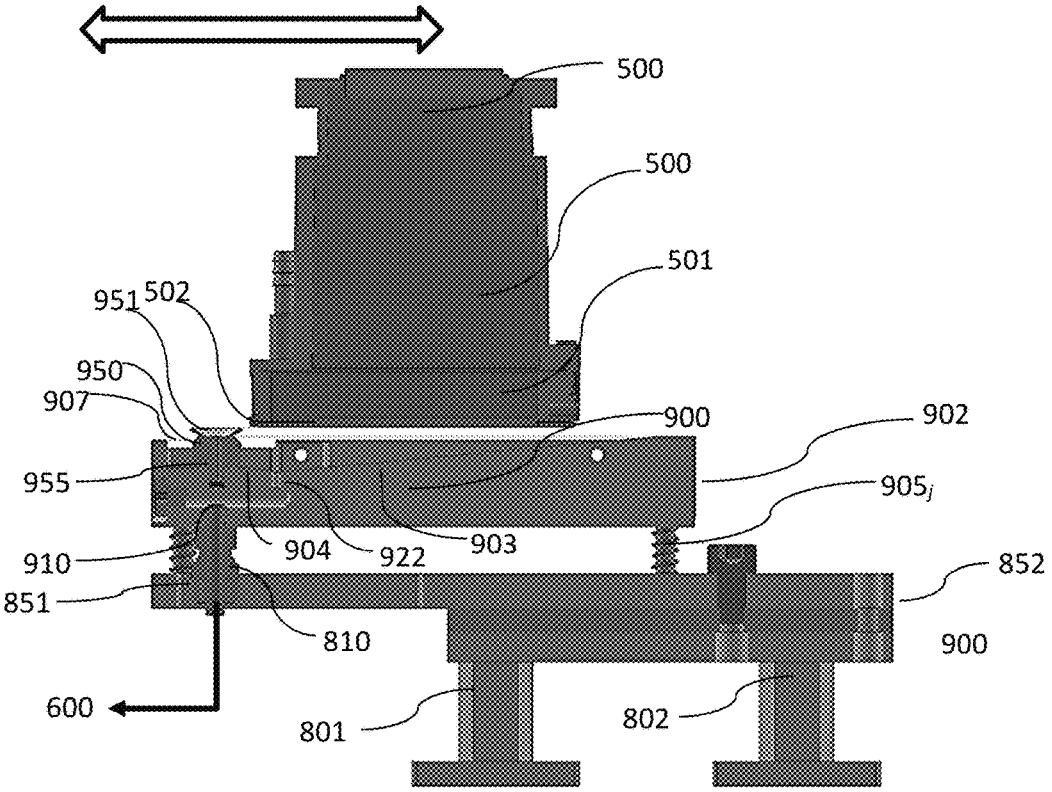
FIG. 13A illustrates a X-Z cross section LL of front elevation view of the inkjet printing head(s) coupled to another embodiment of the cleaner immediately before suction cleaning, with FIG. 13B illustrating the same cross section during the suction cleaning.
Figure 13B:
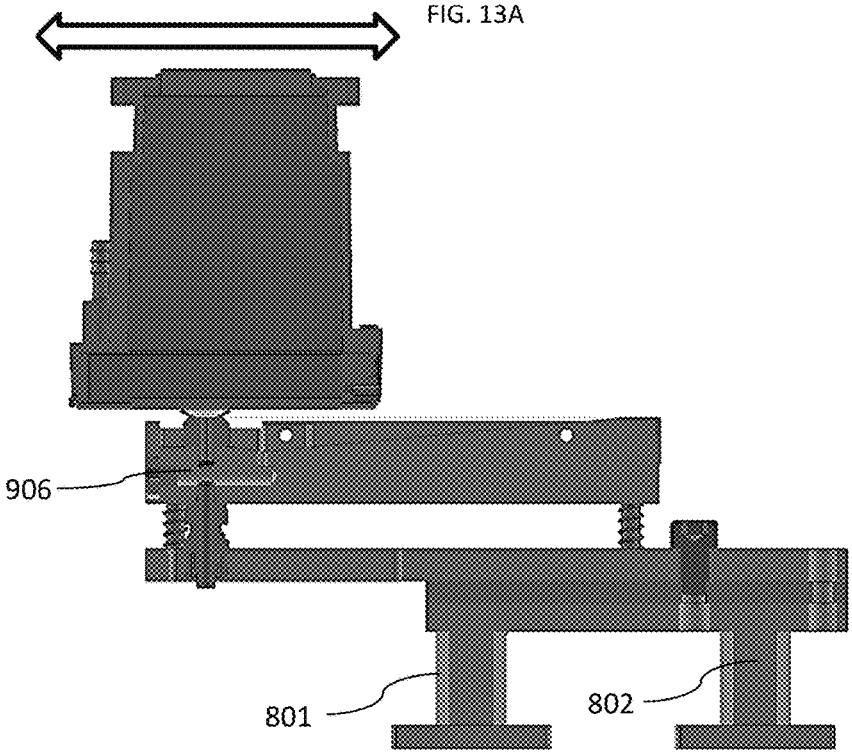

In an embodiment, other cleaning devices are used in the systems described herein. As illustrated in FIGS. 11A and 13A,B, provided herein is contactless inkjet print head cleaner comprising: an elongated slab 800 (see e.g., FIG. 11A) having proximal end 851 and distal end 852 (see e.g., FIG. 13A), disposed along opposite sides of a longitudinal axis (not shown) of elongated slab 800, an anterior side 856 disposed transverse to the longitudinal axis, a posterior side 857 (not shown) disposed opposite to anterior side 856 (see e.g., FIG. 11A), apical surface 853 and basal surface 854. As illustrated in FIG. 11A, two print heads 500 are shown, with the left print head being numbered with prime version. The numbering of the right print head uses the same numbers for the same elements without prime and is discussed herein.

Also illustrated in FIG. 11A-13B, is platform 900 with longitudinal axis ($X_{L900}$) (see e.g., FIG. 12B) aligned in parallel to the longitudinal axis of slab 800, the platform having apical surface defining distally slanted proximal sink portion 907, (see e.g., FIG. 12A), distally slanted distal sink portion 904, and proximally sloped channel 903. Distally slanted proximal sink portion 907, (see e.g., FIG. 12A), distally slanted distal sink portion 904, and proximally sloped channel 903, are configured to collect ink purged from print head 500 orifice plate 502 as print head 500 slidably translates along platform 900 longitudinal axis ($X_{L900}$), thus catching purged ink that is not actively collected by suction nipple 950. In certain embodiments distally slanted proximal sink portion 907, (see e.g., FIG. 12A), distally slanted distal sink portion 904, and proximally sloped channel 903 can be coated with material that is thermodynamically incompatible with the ink, referring to a hydrophobic surface for a hydrophilic ink and a hydrophilic surface to receive and collect hydrophobic ink. Using the coating can facilitate beading (in other words, forming droplets) of the ink on the surface to assist in drainage.

Figure 12A:
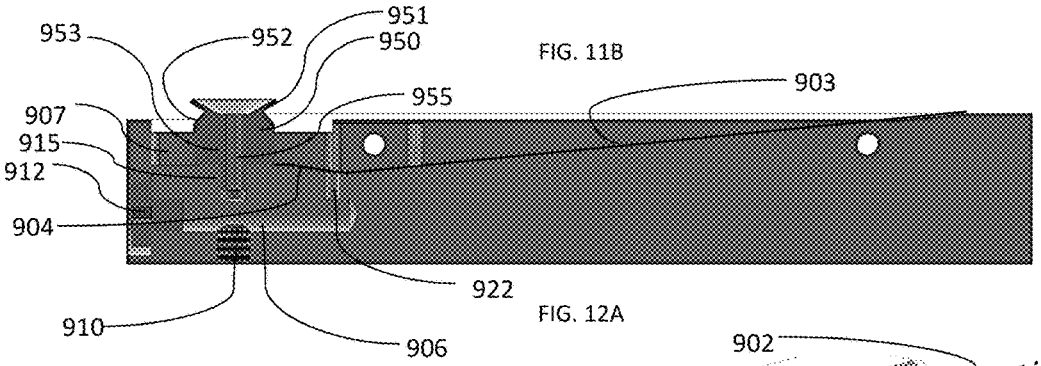
FIG. 12A illustrates X-Z cross section of another embodiment of the cleaner slab, with FIG. 12B providing an isometric view thereof.

As further illustrated in FIG. 12A, platform 900 further defines distal drainage bore 922, and proximal drainage bore 915 wherein distal drainage bore 922 and proximal drainage bore 915 are in fluid communication with basin 906 defined in platform 900. As shown, basin 906 (see e.g., FIG. 13A) further having main drainage conduit 910, whereby main drainage conduit 910 being in communication with vacuum source (not shown, see e.g., FIG. 10). Also shown in FIGS. 12B-14 e.g., cylindrical suction nipple 950, operably coupled to proximal drainage bore 915, whereby suction nipple 950 having suction tube 955 coaxially disposed and in communication with basin 906.

Figure 11B:
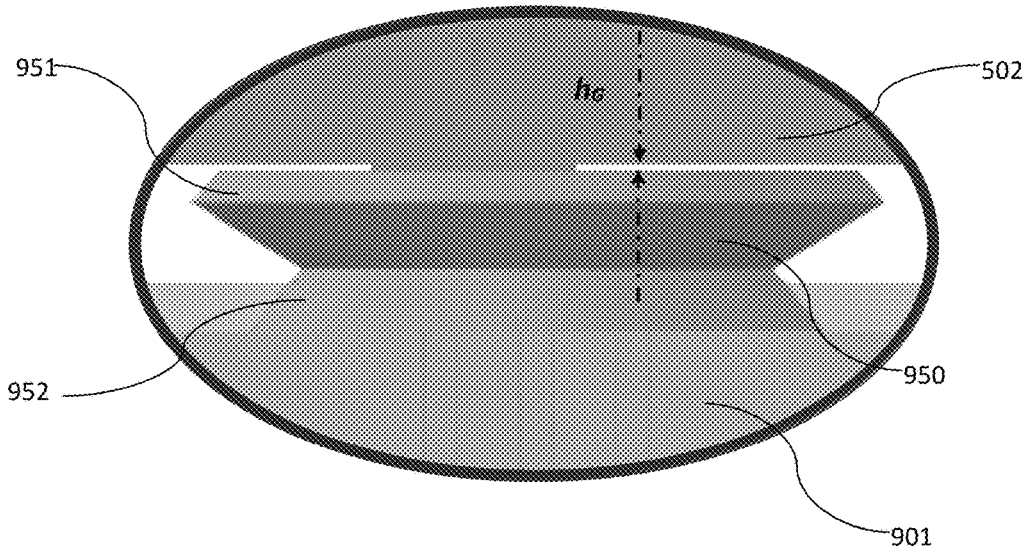
Figure 14:
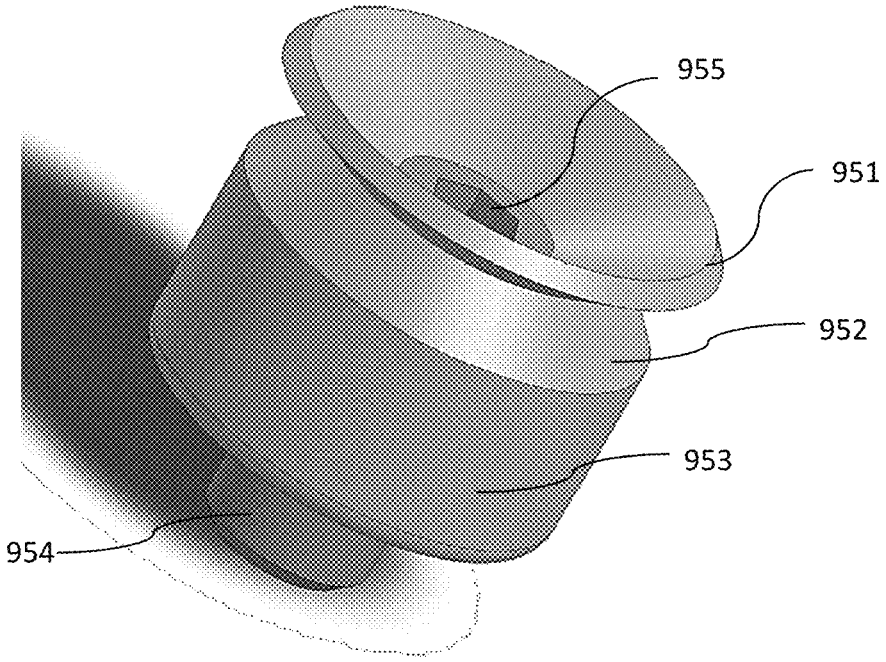
FIG. 14, illustrating suction nipple 950.

As illustrated in FIGS. 11B and 14, suction nipple 950, used in the cleaning devices, methods, and systems provided herein can comprise: apical funnel 951, configured to collect purged ink under vacuum from orifice plate 502; cylindrical mid-section 953; frusto-conical portion 952, disposed between apical funnel 951 and cylindrical mid-section 953; and basal portion 954, wherein apical funnel 951, the cylindrical mid-section 953, the frusto-conical portion 952 and basal portion 954 are all coaxial with bore 955 traversing the length of suction nipple 950. As illustrated in FIG. 13A, proximal drainage bore 915 can be configured to accommodate basal portion 954 of the suction nipple, or a portion thereof, such that suction nipple 950 is engaged in proximal drainage bore 915 being operably coupled (e.g., frictionally coupled) to platform 900. Moreover, apical funnel 951 (or in another embodiment, all portions of suction nipple 950) can be formed of a resilient material. The resilient material can be used to prevent damage to orifice plate 502 in circumstances where hard residue is caught in hap ($h_G$, see e.g., FIG. 11*b*) between apical funnel 951 of suction nipple 950 and print head 500 orifice plate 502 as that orifice plate 502 slides from a distal position (see e.g., FIG. 13A) to a proximal position (see e.g., FIG. 13B) while hovering above apical funnel 951 during cleaning. Accordingly and in another embodiment, the resilient material forming apical funnel and/or suction nipple 950 can be an elastomeric material, such as rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, or a closed or open-cell foams thereof.

In an embodiment, the term "elastomer" or "elastomeric" refers to rubbers or polymers that have resiliency properties similar to those of rubber. For example, the term elastomer reflects a property of the material, that it can undergo a substantial elongation and then return to its original dimensions upon release of the stress elongating the elastomer. In all cases an elastomer can be capable of undergoing at least 10% elongation (at a thickness of 0.5 mm), for example at least 30% elongation, and return to at least 50% recovery after being held at that elongation for 2 seconds and after being allowed 1 minute relaxation time. In an embodiment, the elastomer used in the cleaning devices, methods, and systems provided herein can undergo 25% elongation without exceeding its elastic limit. In some cases elastomers can undergo elongation to as much as 300% or more of their original dimensions without tearing or exceeding the elastic limit of the composition. Elastomers are typically defined to reflect this elasticity as in ASTM Designation D883-96 as a macromolecular material that at room temperature returns rapidly to approximately its initial dimensions and shape after substantial deformation by a weak stress and release of the stress. ASTM Designation D412-98A can be an appropriate procedure for; testing rubber properties in tension to evaluate elastomeric properties.

As illustrated further in FIGS. 11A and 13A, main drainage conduit 910 can be coupled to elongated slab 800 at proximal end 901 of platform 900 to proximal end of slab 851 via coupling member 810 and be configured to be in liquid communication with vacuum source 600 (see e.g., FIG. 10).

Figure 12B:
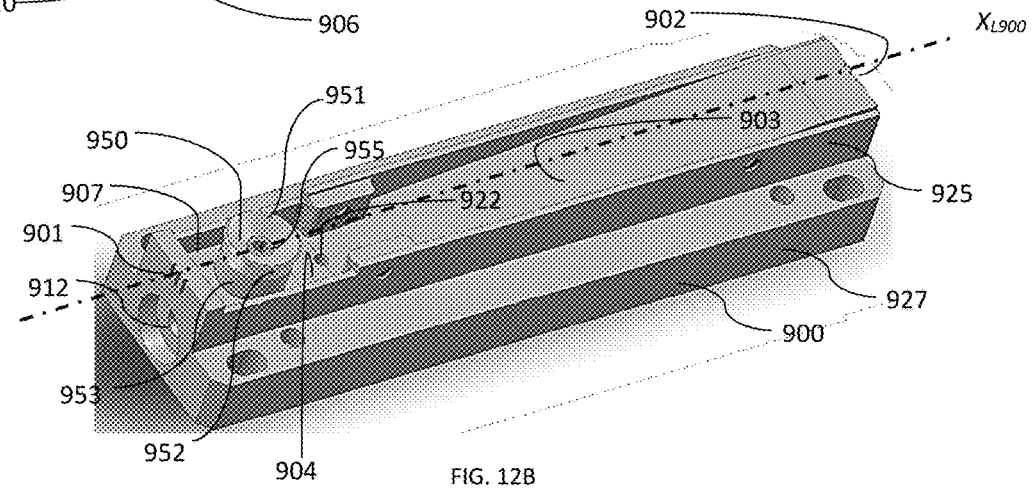

FIG. 11A, as well as 13A and 13B also illustrates vibration dampeners $\mathbf{205}_j$. It is noted that while shown, their presence is optional. As indicated herein, vibration dampeners $\mathbf{205}_j$ used in the cleaning devices, methods, and systems provided herein can be used to maintain orifice plate 502 parallel to the upper annulus defined by apical funnel 951 and would be desirable in circumstances where apical funnel 951 is NOT made of soft, resilient material. However, in circumstances where either apical funnel 951 or most of the parts of suction nipple 950 or formed of resilient, elastomeric soft material, e.g., silicon, polyurethane etc., the use of vibration dampeners $\mathbf{205}_j$ can be optional. Also shown in FIG. 11A, is proximal cap 911. Also shown is front support column 801 (with rear support column 802 illustrated, e.g., in FIG. 13B). Turning to FIG. 12B, illustrating platform 900 is comprised of base 927 and stage 925 having apical surface defining distally slanted proximal sink portion 907, (see e.g., FIG. 12A), distally slanted distal sink portion 904, and proximally sloped channel 903. Base 927 has several apertures therein configured to facilitate coupling of platform 900 to elongated slab 800, either directly or via vibration dampeners $\mathbf{205}_j$. Further illustrated in FIG. 12B, is proximal recess 912, configured to receive and engage proximal cap 911.

In an embodiment, the cleaning devices provided herein, are used in the methods described. Accordingly and as illustrated in FIGS. 11A-14, provided is a method of purging ink from an inkjet print head 500 having proximal end 501, a distal end (not shown, 503), and an orifice plate 502, the method comprising: providing a contactless inkjet print head cleaner 20 (see e.g., FIG. 11A), comprising: elongated slab 800 having proximal end 851 and a distal end 852 (see e.g., FIG. 13A) disposed along opposite sides of a longitudinal axis of elongated slab 800, an anterior side 856 disposed transverse to the longitudinal axis, a posterior side 857 (not shown) disposed opposite to anterior side 856 (see e.g., FIG. 11A), apical surface 853 and basal surface 854; platform 900 having base 927 and stage 925, with longitudinal axis ($X_{L900}$), aligned in parallel to the longitudinal axis of slab 800, platform 900 defining distally slanted proximal sink portion 907, distally slanted distal sink portion 904, proximally sloped channel 903 (see e.g., FIG. 12B), distal drainage bore 922, and proximal drainage bore 915, (see e.g., FIG. 12A), wherein distal drainage bore 922 and proximal drainage bore 915 are in fluid communication with basin 906 defined in platform 900, whereby basin 906 further having main drainage conduit 910, main drainage conduit 910 being in communication with vacuum source (not shown, see e.g., 600 FIG. 10); and cylindrical suction nipple 950 operably coupled to proximal drainage bore 915, suction nipple 950 having suction tube 955 coaxially disposed and in communication with basin 906. Using cleaning device 20 and while sliding orifice plate 502 proximally along longitudinal axis ($X_{L900}$) of platform 900 (see e.g., FIG. 13A), purging ink from print head 500 when distal end 503 (not shown) of print head 500 is vertically aligned with distal end 902 of platform 900, At this point, while ink is purged, orifice plate 502 is not above apical funnel 951 of suction nipple 950 and all purged ink is captured and collected in proximally slanted channel 903 by gravity, draining via distal drainage bore 922 into basin 906. Once proximal end 501 of print head 500 orifice plate 502 is above suction nipple 950 (see e.g., FIG. 13B), and using the vacuum source (not shown, see e.g., 600 FIG. 10) to apply vacuum, slidably coupling inkjet print head 500 to cylindrical suction nipple 950, leaving cleaning gap ($h_G$, see e.g., FIG. 11B); and using the main drainage conduit 910, removing the purged ink from basin 906.

The ink and other components (e.g., build up residue, solid sediment and the like) suctioned off using the system described herein can be transported to a recycling system (see e.g., FIG. 10), modified and returned to print head 500 ink reservoir. As indicated hereinabove, the recycling subsystem may comprise various components adapted to specifically operate with cleaning device 20, for example filters, adsorbing elements, manifolds, motors, circuitry etc., as well as addition of various solvents and additives and the like. For example, the term "recycling" in connection with contactless cleaning device 20, refers to a sub-system used to reprocess the purged content of basin 906 to a condition where it can be used effectively in future printing operation carried out.

Accordingly and in an embodiment, the step of removing the purged ink from the basin 906, via main drainage conduit 910 in the methods described herein, can further comprises removing the purged ink to a degassing tank (see e.g., 702, FIG. 10). Upon removing the purged ink and other components, using valves (see e.g., V-3, FIG. 10), shunts and other processing components, flow of purged ink and other components can be stopped and the degassing tank is isolated from the ambient pressure system of contactless cleaner 20, whereby, using vacuum source 600, the ink is degassed (see e.g., 703, FIG. 10). Following degassing of the ink, and optionally further treatment to remove undesired components (e.g., sediments, build up residue, etc.) vacuum source 600 is disconnected from the degassing tank and the degassed and optionally treated ink is allowed to flow to ink reservoir 400 (see e.g., 704, FIG. 10). Once full, or on-demand, or periodically, the degassed ink from ink reservoir 400 can be transported (e.g., using various pumps, positive pressure, or additional vacuum sources), to inkjet print head 500 internal reservoir (see e.g., 705, FIG. 10), thereby recycling the ink.

The terms "first," "second," and the like, when used herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the channel(s) includes one or more channel). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right," "radial," "vertical," "upward," "downward," "outer," "inner," "exterior," "interior," "intermediate," etc., are merely used for convenience in describing the various embodiments of the present disclosure.

The term "coupled", including its various forms such as "operably coupled", "coupling" or "coupleable", refers to and comprises any direct or indirect, structural coupling, connection or attachment, or adaptation or capability for such a direct or indirect structural or operational coupling, connection or attachment, including integrally formed components and components which are coupled via or through another component or by the forming process (e.g., an electromagnetic field). Indirect coupling may involve coupling through an intermediary member or adhesive, or abutting and otherwise resting against, whether frictionally (e.g., against a wall) or by separate means without any physical connection.

The contactless cleaner used in the systems and methods for removing purged ink without mechanical or fluid contact described herein can further be in electric communication with at least one sensor (e.g., barometer) and a processor, configured to maintain a predetermined pressure or a programmable pressure profile throughout the cleaning process and the recycling process. For example, the system can comprise sensor array at various locations, with temperature and/or pressure and/or viscosity data feedback to the processor, which, in turn, will control the various valves, affecting gas flow and the like.

Other sensors can be incorporated into the system, for example, image (visual) sensors (e.g., CMOS, CCD, for example to monitor ink color, drop shape/volume), microflow (or flow) sensors (e.g., EM based, Resonant feedback based, Pitot-based) viscosity sensors, timing sensors, conductivity sensors, or an array comprising one or more of the foregoing. The sensors, including the temperature sensors can provide data to a processor comprising memory having thereon computer-readable media with a set of executable instruction enabling the processor, being in electronic communication with a driver or drivers, to automatically (in other words, without user intervention) change the position of the contactless cleaner, relative to the print head. The processor may also determine whether purging ink is recycled back to an ink reservoir in fluid communication with the print head.

The processor can further have a memory module with computer readable media stored thereon, comprising a set of instructions thereon configured to carry out the cleaning and/or recycling methods described herein, provide temperature/pressure controls, and the like.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

All ranges disclosed herein are inclusive of the endpoints, and the endpoints are independently combinable with each other. Furthermore, the terms "first," "second," and the like, herein do not denote any order, quantity, or importance, but rather are used to denote one element from another.

Likewise, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such.

While in the foregoing specification the systems and methods allowing CIP of print heads by selectably alternating the position of a mask between printing, cleaning and purging positions have been described in relation to certain preferred embodiments, and many details are set forth for purpose of illustration, it will be apparent to those skilled in the art that the disclosure of the systems and methods allowing CIP of print heads by selectably alternating the position of a mask between printing, cleaning and purging positions is susceptible to additional embodiments and that certain of the details described in this specification and as are more fully delineated in the following claims can be varied considerably without departing from the basic principles of this disclosure.

What is claimed is:

1. A contactless inkjet print head cleaner comprising:

a. an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface;

b. a platform with a longitudinal axis aligned in parallel to the longitudinal axis of the slab, the platform defining a plurality of parallel channels disposed transverse to the longitudinal axis of the platform, each channel having a posterior end in communication with a pressurized cleaning gas medium and an anterior end in fluid communication with a suction duct;

c. a proximal spacer extending apically from the platform and d. a distal spacer extending apically from the rectangular platform.

2. The cleaner of claim 1, wherein the posterior end of each of the plurality of channels terminates in a longitudinal posterior groove adjoining the plurality of channels.

3. The cleaner of claim 2, wherein the longitudinal posterior groove is in communication with a longitudinal posterior duct extending longitudinally from the proximal end to the distal end of the slab.

4. The cleaner of claim 3, wherein the apical surface further defines a proximal posterior bore and a distal posterior bore, each of the proximal posterior bore and the distal posterior bore extending basally from the apical surface to the posterior duct.

5. The cleaner of claim 4, wherein the proximal posterior bore and/or the distal posterior bore is in communication with a source of pressurized cleaning gas medium, configured to create cleaning gas flow through the posterior duct to the longitudinal posterior groove.

6. The cleaner of claim 5, wherein the source of pressurized cleaning gas is configured to provide cleaning gas flow rate sufficient to induce a Venturi effect within the channels when coupled to the inkjet print head abutting the proximal and distal spacers.

7. The cleaner of claim 1, wherein the anterior end of each of the plurality of channels terminates in a longitudinal anterior groove adjoining the plurality of channels.

8. The cleaner of claim 7, wherein the longitudinal posterior groove is in communication with a longitudinal anterior suction duct extending longitudinally from the proximal end to the distal end of the slab.

9. The cleaner of claim 8, wherein the basal surface further defines a median anterior drain, the median anterior drain extending apically from the basal surface to the anterior suction duct.

10. The cleaner of claim 9, wherein the median anterior drain is coupled to a vacuum source.

11. The cleaner of claim 10, wherein the median anterior drain is in fluid communication with a degassing tank disposed between the median anterior drain and the vacuum source.

12. A method of cleaning an inkjet print head comprising:

a. providing a contactless inkjet print head cleaner comprising:

i. an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface;

ii. a platform with a longitudinal axis in parallel with the longitudinal axis of the slab, the platform defining a plurality of parallel channels disposed transverse to the longitudinal axis of the platform, each channel having a posterior end in communication with a pressurized cleaning gas medium and an anterior end in fluid communication with a suction duct;

iii. a proximal spacer extending apically from the platform; and iv. a distal spacer extending apically from the rectangular platform;

b. coupling the inkjet print head to the apical surface of the slab, abutting the proximal and distal spacers, thereby creating a cleaning gap;

c. contacting the cleaning gap with the pressurized cleaning gas medium;

d. purging ink from the inkjet print head; and e. using the suction duct, removing the purged ink from the anterior end of each of the plurality of parallel channels.

13. The method of claim 12, wherein the posterior end of each of the plurality of parallel channels terminates in a longitudinal posterior groove adjoining the plurality of channels.

14. The method of claim 13, wherein the longitudinal posterior groove is in communication with a longitudinal posterior duct extending longitudinally from the proximal end to the distal end of the slab.

15. The method of claim 14, wherein the apical surface further defines a proximal posterior bore and a distal posterior bore, each of the proximal posterior bore and the distal posterior bore extending basally from the apical surface to the posterior duct.

16. The method of claim 15, wherein, in the step of contacting the cleaning gap with the pressurized cleaning gas medium, the proximal posterior bore and/or the distal posterior bore is in communication with a source of pressurized cleaning gas medium, configured to create cleaning gas flow through the posterior duct to the cleaning gap.

17. The method of claim 16, wherein the source of pressurized cleaning gas is configured to provide cleaning gas flow rate sufficient to induce a Venturi effect within the cleaning gap.

18. The method of claim 12, wherein the anterior end of each of the plurality of channels terminates in a longitudinal anterior groove adjoining the plurality of channels.

19. The method of claim 18, wherein the longitudinal posterior groove is in communication with a longitudinal anterior suction duct extending longitudinally from the proximal end to the distal end of the slab.

20. The method of claim 19, wherein the basal surface further defines a median anterior drain, the median anterior drain extending apically from the basal surface to the anterior suction duct.

21. The method of claim 20, wherein the median anterior drain is coupled to a vacuum source.

22. The method of claim 21, wherein the median anterior bore is in fluid communication with a degassing tank disposed between the median anterior drain and the vacuum source.

23. The method of claim 22, wherein the step of removing the purged ink from the anterior end of each of the plurality of parallel channels comprises removing the purged ink to the degassing tank.

24. The method of claim 23, further comprising:

a. terminating removing the purged ink;

b. using the vacuum source, degassing the purged ink;

c. terminating the vacuum; and d. streaming the degassed ink to an ink reservoir.

25. The method of claim 24 further comprising streaming the degassed ink from the ink reservoir to the inkjet print head, thereby recycling the ink.

26. A system for recycling inkjet ink comprising:

a. a contactless inkjet print head cleaner comprising:

i. an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface;

ii. a platform having a longitudinal axis aligned in parallel to the longitudinal axis of the slab, the platform defining a plurality of parallel channels disposed transverse to the longitudinal axis of the platform, each channel having a posterior end in communication with a pressurized cleaning gas medium and an anterior end in fluid communication with an anterior suction duct;

iii. a proximal spacer extending apically from the platform; and iv. a distal spacer extending apically from the rectangular platform;

b. a vacuum pump, in communication with the suction duct;

c. a pressurized vessel, holding the pressurized cleaning gas medium;

d. a degassing tank, in communication with the anterior suction duct, coupled to the vacuum pump;

e. an ink reservoir, in fluid communication with the degassing tank; and f. a print head, in fluid communication with the ink reservoir.

27. The system of claim 26, wherein the posterior end of each of the plurality of channels terminates in a longitudinal posterior groove adjoining the plurality of channels.

28. The system of claim 27, wherein the longitudinal posterior groove is in communication with a longitudinal posterior duct extending longitudinally from the proximal end to the distal end of the slab.

29. The system of claim 28, wherein the apical surface further defines a proximal posterior bore and a distal posterior bore, each of the proximal posterior bore and the distal posterior bore extending basally from the apical surface to the posterior duct.

30. The system of claim 29, wherein the proximal posterior bore and/or the distal posterior bore is in communication with a source of pressurized cleaning gas medium, configured to create cleaning gas flow through the posterior duct to the longitudinal posterior groove.

31. The system of claim 30, wherein the source of pressurized cleaning gas is configured to provide cleaning gas flow rate sufficient to induce a Venturi effect within the channels when coupled to the inkjet print head abutting the proximal and distal spacers.

32. The system of claim 26, wherein the anterior end of each of the plurality of channels terminates in a longitudinal anterior groove adjoining the plurality of channels.

33. The system of claim 32, wherein the longitudinal posterior groove is in communication with a longitudinal anterior suction duct extending longitudinally from the proximal end to the distal end of the slab.

34. The system of claim 33, wherein the basal surface further defines a median anterior drain, the median anterior drain extending apically from the basal surface to the anterior suction duct.

35. The system of claim 34, wherein the median anterior drain is coupled to a vacuum source.

36. The system of claim 35, wherein the median anterior bore is in fluid communication with a degassing tank disposed between the median anterior drain and the vacuum source.

37. A contactless inkjet print head cleaner comprising:

a. an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface;

b. a platform with longitudinal axis aligned in parallel to the longitudinal axis of the slab, the platform defining a distally slanted proximal sink portion, a distally slanted distal sink portion, a proximally sloped channel, a distal drainage bore, and a proximal drainage bore wherein the distal drainage bore and proximal drainage bore are in fluid communication with a basin defined in the platform, the basin further having a main drainage conduit, the main drainage conduit being in communication with a vacuum source; and c. a cylindrical suction nipple operably coupled to the proximal drainage bore, the suction nipple having a suction tube coaxially disposed and in communication with the drainage reservoir.

38. The contactless inkjet print head cleaner of claim 37, wherein the suction nipple comprise:

a. an apical funnel;

b. a cylindrical mid-section;

c. a frusto-conical portion disposed between the apical funnel and the cylindrical mid-section; and d. a basal portion, wherein the apical funnel, the cylindrical mid-section, the frusto-conical portion and the basal portion are all coaxial.

39. The contactless inkjet print head cleaner of claim 38, wherein the proximal drainage bore is configured to accommodate the basal portion of the suction nipple, or a portion thereof.

40. The contactless inkjet print head cleaner of claim 39, wherein the apical funnel is formed of a resilient material.

41. The contactless inkjet print head cleaner of claim 40, wherein the resilient material is an elastomeric material.

42. The contactless inkjet print head cleaner of claim 41, wherein the elastomeric material is rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, or a closed or open-cell foams thereof.

43. The contactless inkjet print head cleaner of claim 40, wherein the main drainage conduit is coupled to the elongated slab at the proximal end via a coupling member.

44. A method of purging ink from an inkjet print head having a proximal end, a distal end, and an orifice plate, the method comprising:

a. providing a contactless inkjet print head cleaner comprising:

i. an elongated slab having a proximal end and a distal end disposed along opposite sides of a longitudinal axis of the elongated slab, an anterior side disposed transverse to the longitudinal axis, a posterior side disposed opposite to the anterior side, an apical surface and a basal surface;

ii. a platform with longitudinal axis aligned in parallel to the longitudinal axis of the slab, the platform defining a distally slanted proximal sink portion, a distally slanted distal sink portion, a proximally sloped channel, a distal drainage bore, and a proximal drainage bore wherein the distal drainage bore and proximal drainage bore are in fluid communication with a basin defined in the platform, the basin further having a main drainage conduit, the main drainage conduit being in communication with a vacuum source; and iii. a cylindrical suction nipple operably coupled to the proximal drainage bore, the suction nipple having a suction tube coaxially disposed and in communication with the drainage reservoir;

b. while sliding the orifice plate proximally along the longitudinal axis of the platform, purging ink from the print head when the distal end of the print head is aligned with the distal end of the platform; and c. using the vacuum source to apply vacuum, slidably coupling the inkjet print head to the cylindrical suction nipple, leaving a cleaning gap; and d. using the main drainage conduit, removing the purged ink from basin.

45. The method of claim 44, wherein the suction nipple comprise:

a. an apical funnel;

b. a cylindrical mid-section;

c. a frusto-conical portion disposed between the apical funnel and the cylindrical mid-section; and d. a basal portion, wherein the apical funnel, the cylindrical mid-section, the frusto-conical portion and the basal portion are all coaxial.

46. The method of claim 45 wherein the gap between the apical funnel and the orifice plate is between about 0.1 mm and about 3.0 mm.

47. The method of claim 46, wherein the proximal drainage bore is configured to accommodate the basal portion of the suction nipple, or a portion thereof.

48. The method of claim 47, wherein the apical funnel is formed of a resilient material.

49. The method of claim 48, wherein the resilient material is rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, or a closed or open-cell foams thereof.

50. The method of claim 48, wherein the main drainage conduit is coupled to the elongated slab at the proximal end via a coupling member.

51. The method of claim 50, wherein the main drainage conduit is in fluid communication with a degassing tank disposed between the main drainage conduit and the vacuum source.

52. The method of claim 51, wherein the step of removing the purged ink from the basin comprises removing the purged ink to the degassing tank.

53. The method of claim 52, further comprising:

a. terminating the step of removing the purged ink;

b. using the vacuum source, degassing the purged ink;

c. terminating the vacuum; and d. streaming the degassed ink to an ink reservoir.

54. The method of claim 24 further comprising streaming the degassed ink from the ink reservoir to the inkjet print head, thereby recycling the ink.

* * * * *